US006467585B1

(12) United States Patent
Gozzo et al.

(10) Patent No.: US 6,467,585 B1
(45) Date of Patent: Oct. 22, 2002

(54) WIRELESS SAFETY CHAIN FOR ELEVATOR SYSTEM

(75) Inventors: Michael Gozzo, Groton; Robert G. Morgan, Bolton; Alberto Vecchiotti, Middletown, all of CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/899,400

(22) Filed: Jul. 5, 2001

(51) Int. Cl.[7] ..... B66B 5/02; B66B 1/34

(52) U.S. Cl. ..... 187/391; 187/247

(58) Field of Search ..... 187/247, 277, 187/287, 289, 391, 393, 413, 316, 280; 49/26, 120; 318/778, 779, 798, 759, 567, 569; 340/505, 507, 518, 521, 522, 531, 539, 542, 825.69

(56) References Cited

U.S. PATENT DOCUMENTS 4,108,281 A * 8/1978 Glaser ..... 187/280
4,753,323 A * 6/1988 Kahkipuro ..... 187/317
4,904,916 A * 2/1990 Gisske et al. ..... 182/2.9
5,708,416 A * 1/1998 Zaharia et al. ..... 198/322
5,780,787 A * 7/1998 Kamani et al. ..... 187/316
5,886,497 A * 3/1999 Zaharia ..... 318/779
6,173,814 B1 1/2001 Herkel et al.
6,193,019 B1 * 2/2001 Sirigu et al. ..... 187/391

FOREIGN PATENT DOCUMENTS

JP 04354777 A * 12/1992 ..... B66B/5/00
JP 05116871 A * 5/1993 ..... B66B/11/02
JP 07206299 A * 8/1995 ..... B66B/3/00

* cited by examiner

*Primary Examiner*—Jonathan Salata
(74) *Attorney, Agent, or Firm*—Wall Marjama & Bilinski LLP

(57) ABSTRACT

A wireless safety chain for an elevator system includes a base transceiver connected to a system controller. A plurality of safety chain components each includes a physical sensor such as a switch, and a wireless transceiver. The physical sensor monitors the component status. The wireless transceiver communicates among the other safety chain components and the system controller. The wireless safety chain preferably employs a token scheme, where a token is sent from the base transceiver to one component, which in turn sends the token to another component, and so on, until the token returns to the base transceiver. Failure of the token to return to the base transceiver in a predetermined amount of time signals that the elevator system is unsafe.

9 Claims, 2 Drawing Sheets

WIRELESS SAFETY CHAIN FOR ELEVATOR SYSTEM

FIELD OF THE INVENTION

This invention relates generally to the field of safety equipment used in elevator systems, and more particularly to a safety chain which is implemented using wireless communication.

BACKGROUND OF THE INVENTION

The elevator controller, located in the machine room, interfaces to a number of devices in the hoistway and the hall. These devices are characterized into three functional area: user input devices (such as fixtures), diagnostic devices (non safety critical sensors) and safety chain devices (safety critical sensors). The current wired architecture includes a main trough that runs the length of the hoistway. From the main trough, smaller local conduit runs to each device in the hall fixture and safety chain systems. The hoistway devices are connected to the machine room via wires. These wires are usually enclosed in a rigid and non-rigid conduit. Local building codes regulate the size and material of the main trough and local conduit (metallic, plastic, flex or rigid). In addition, in some regions the local conduit is not required if appropriately insulated wire is used.

The system configuration depends on customer needs. Some elevators have a lantern on every floor, others have one only at the lobby. In a bank of elevators (multiple elevators side by side) there may be any number of buttons (not to exceed the number of elevators) depending on the customer requirement.

The safety circuit is a separate circuit with a discrete number of switches designed to indicate the status of the doors and the position of the elevator at the extremes of the hoistway (terminal switches). In addition there are a number of other switches designed to monitor the safety status of other elevator components. Some of these safety switches are controlled by the car such as the overspeed governor and the limit switch. Others are controlled by the doors, such as the switches and the locks of the landing doors. These switches are wired together in a serial circuit known as the "safety chain." If this circuit is "open", i.e. one of the physical switches is not closed, the elevator is deemed "unsafe" and is shutdown by the controller.

Because of the critical nature of the safety chain, the latency, i.e., the amount of time it takes to query the status of the system, must be very small, approximately 100 ms. In addition, the system must fail in a safe manner, i.e., the malfunction of any of the components in the safety chain must not cause the elevator to operate in an unsafe manner.

U.S. Pat. No. 6,173,814 (Herkel et al.) discloses an electronic safety system having a dual redundant safety bus, incorporated herein by reference. The electronic safety system still requires a lot of wiring in the hoistway to handle the safety system communications.

SUMMARY OF THE INVENTION

Briefly stated, a wireless safety chain for an elevator system includes a base transceiver connected to a system controller. A plurality of safety chain components each includes a physical sensor such as a switch, and a wireless transceiver. The physical sensor monitors the component status. The wireless transceiver communicates among the other safety chain components and the system controller.

The wireless safety chain preferably employs a token scheme, where a token is sent from the base transceiver to one component, which in turn sends the token to another component, and so on, until the token returns to the base transceiver. Failure of the token to return to the base transceiver in a predetermined amount of time signals that the elevator system is unsafe.

According to an embodiment of the invention, a safety chain for an elevator system includes a controller in wireless communication with a plurality of component nodes; each component node including at least one sensor and communication means for communicating with the controller; each sensor monitoring an operating condition of the elevator system, such that when the operating condition fails, the means for communicating with the controller is switched off; and means for sending at least one token from the controller to each component node and back to the controller, wherein failure of the token to return to the controller within a predetermined amount of time signals that the elevator system is unsafe.

DETAILED DESCRIPTION OF THE PREFERRED EMBODIMENT

Figure 1:
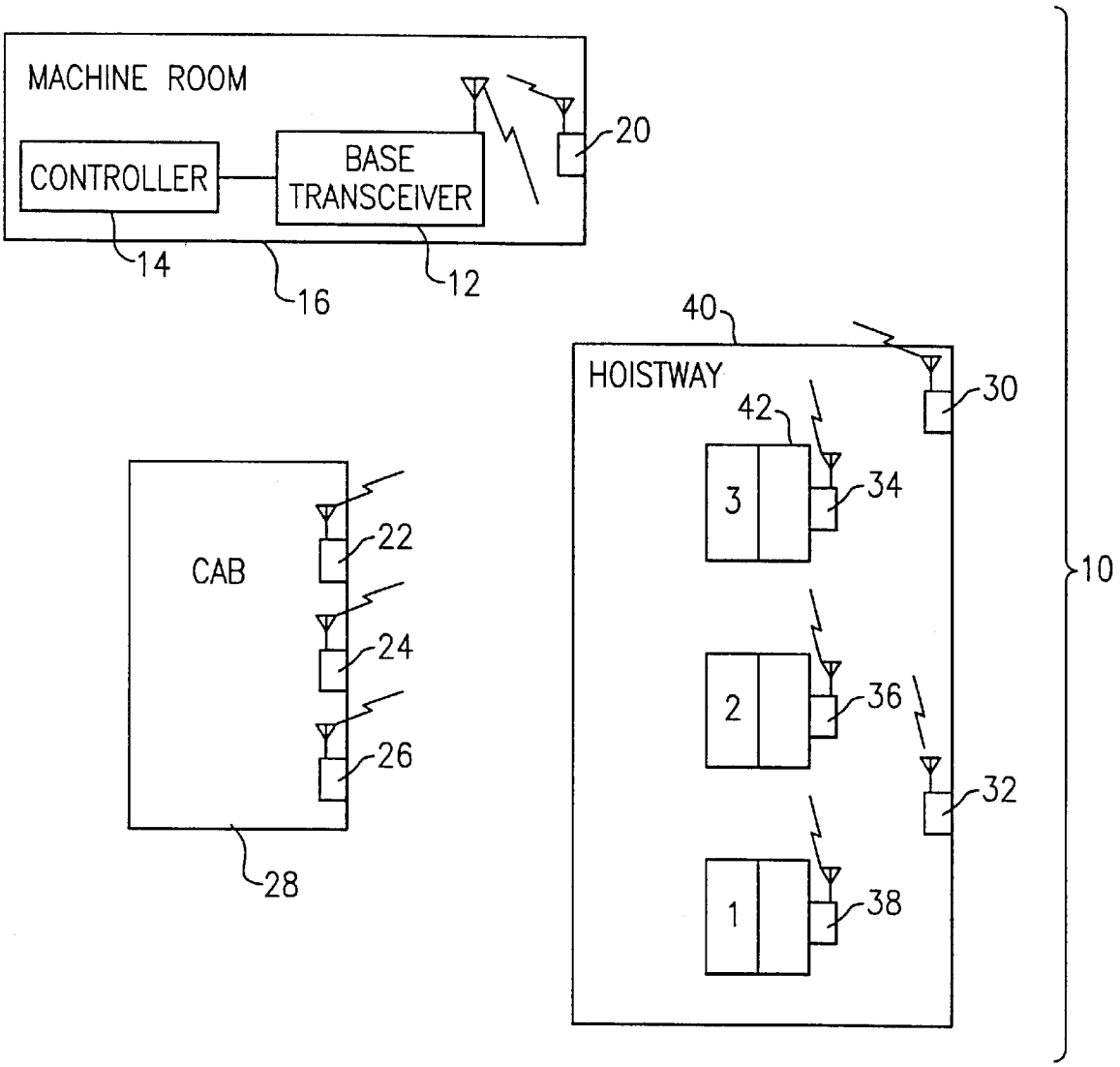
FIG. 1 shows a wireless safety chain architecture according to an embodiment of the invention.

Referring to FIG. 1, a safety chain architecture 10 includes a base transceiver 12 connected to a controller 14. Controller 14 is typically inside a machine room 16. Base transceiver 12 and controller 14 are connected via wireless transceivers to a number of safety chain components. Each component includes a physical sensor, usually a switch, and a wireless transceiver. Power for the transceiver is preferably supplied by battery, hardwire, or a combination of the two, or possibly an inductively coupled system with a recharging circuit riding on the car.

Components include such switches as an overspeed switch 20 in machine room 16, an inspection switch 22, an emergency stop switch 24, and a door switch 26 in an elevator cab 28, and a top limit switch 30, a bottom limit switch 32, and door interlock switches 34, 36, 38 on each floor of a hoistway 40. Other examples of safety chain switches (not shown) are pit emergency switches, governor switch, broken rope switch, etc. The physical sensor or switch monitors the status of the component. For example, door interlock switch 34 monitors whether a landing door 42 is open or closed.

Figure 2:
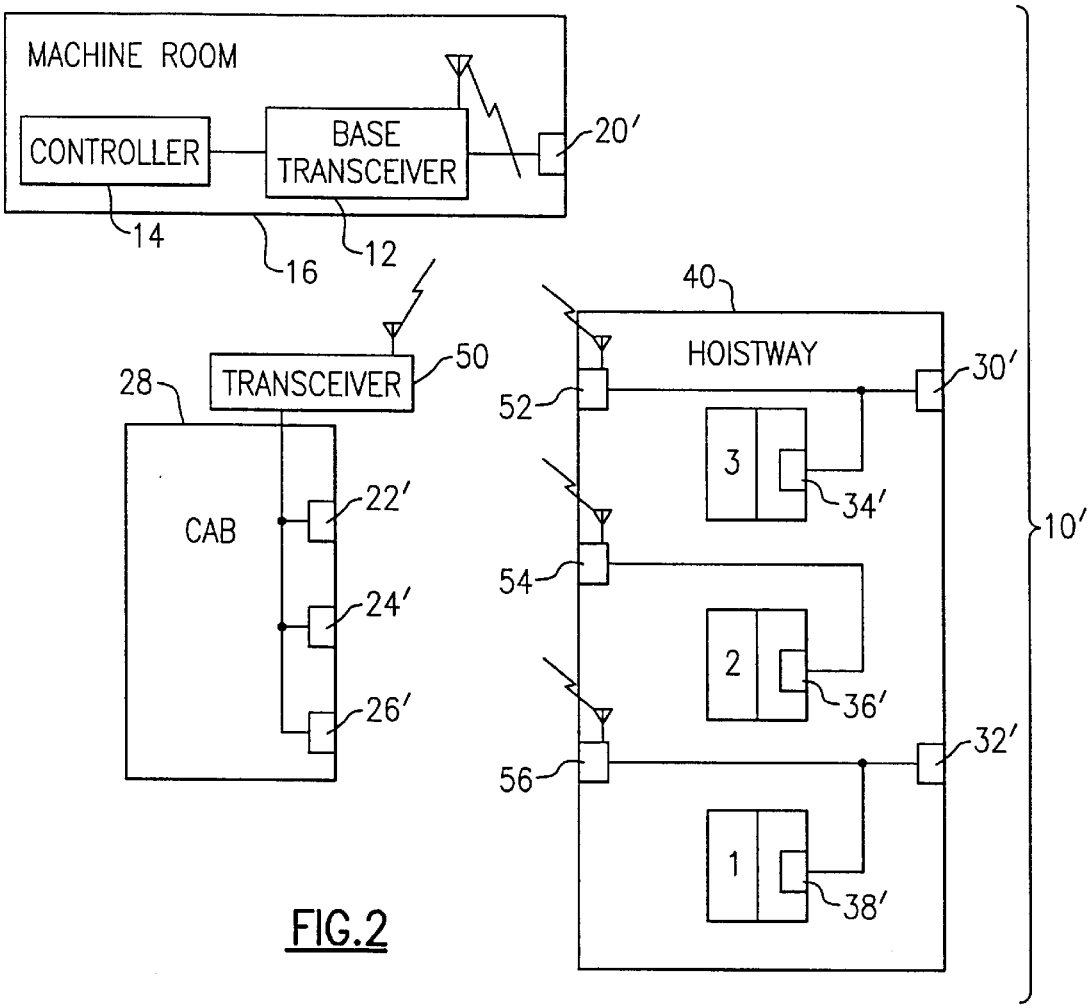
FIG. 2 shows a wireless safety chain architecture according to an embodiment of the invention.

Referring to FIG. 2, an alternate embodiment is shown in which components grouped in the same area, such as one floor, or within the elevator cab, share the same transceiver. In cab 28, for example, switches 22', 24', and 26' are connected to a transceiver 50. On the first floor of hoistway 40, door switch 38' and bottom limit switch 32' are connected to a transceiver 56. On the second floor, door switch 36' is connected to a transceiver 54, while on the third floor, top limit switch 30' and door switch 34' are connected to a transceiver 52. Base transceiver 12 and transceivers 50, 52, 54, and 56 can be low power, high power, spread spectrum, analog, digital, or any other known wireless communication type.

Figure 3:
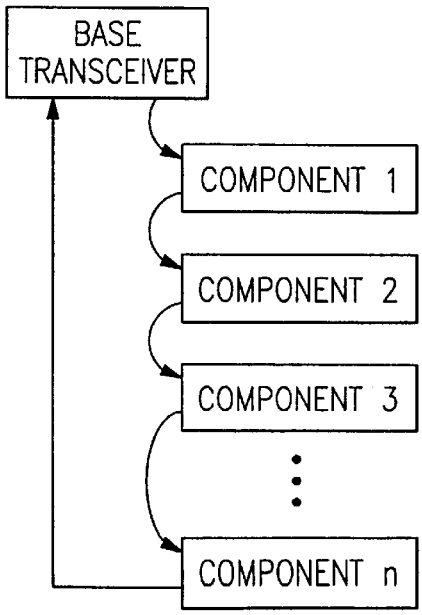
FIG. 3 shows a token ring scheme used in the present invention.

Referring to FIG. 3, the wireless transceiver portion of each component communicates between other safety chain components. In normal operation, the wireless safety chain circuit preferably employs a token scheme, where a token is sent from the base transceiver to a first component, Component 1. This token is then passed from Component 1 to the second component, Component 2, and so on until the token reaches the last component, Component n. At this point the token is sent back to the base transceiver.

The protocol in the system is preferably designed such that in normal operation a given component only receives valid tokens from the previous component in the chain. This can be accomplished using the component addresses so that in normal operation a given component can only receive tokens from a component with a given address and ignore tokens coming from other components.

If the base transceiver receives the token back from the last component within a predetermined amount of time from sending it out, then the elevator is deemed "safe" and allowed to run. If the token is not received in the predetermined amount of time, then the elevator is deemed "unsafe" and is stopped by the controller.

If the elevator is deemed "unsafe", the controller preferably queries each individual component to determine which one has failed, thus providing detailed diagnostics information to a troubleshooting mechanic. This is currently not possible with series wired safety chains, as most of them are, because the components are wired in series and the controller can only detect whether all of the "switches" are closed or open, and not which one is closed.

For added safety, the token sent between components is optionally encoded with any one of a number of standard encryption schemes.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A safety chain for an elevator system, comprising:

a controller in wireless communication with a plurality of component nodes;

each said component node including at least one sensor and communication means for communicating with said controller;

each said sensor monitoring an operating condition of said elevator system, such that when said operating condition fails, said means for communicating with said controller is switched off; and means for sending at least one token from said controller to each component node and back to said controller, wherein failure of said token to return to said controller within a predetermined amount of time signals that said elevator system is unsafe.

2. A safety chain according to claim 1, wherein said plurality of component nodes include:

a first component node located at a lower end of a hoistway and having a bottom limit switch sensor;

a second component node located at an upper end of said hoistway and having a top limit switch sensor;

a third component node located in a machine room and having an overspeed sensor;

a plurality of landing door component nodes, each said landing door component node located near a landing door and having a landing door sensor; and at least one elevator cab component node located on an elevator cab and having an inspection switch sensor, an emergency stop switch sensor, and an elevator cab door sensor.

3. A safety chain according to claim 1, wherein said communication means in each component node includes a wireless transceiver.

4. A safety chain according to claim 1, wherein said communication means includes connection to a wireless transceiver.

5. A safety chain according to claim 4, further comprising a wireless transceiver on each floor serviced by said elevator system, wherein all component nodes on a one floor use a same wireless transceiver on said one floor.

6. A safety chain according to claim 1, wherein said token passes in serial fashion from said controller to each of said component nodes in turn.

7. A safety chain according to claim 6, wherein, after said elevator system is deemed to have an unsafe condition due to said token not returning within said predetermined time, an additional token is sent directly to each component node to determine where said unsafe condition resides.

8. A safety chain according to claim 1, wherein said token passes in parallel fashion from said controller to each of said component nodes in turn.

9. A safety chain according to claim 1, wherein said token is encrypted.

* * * * *